US005409250A

United States Patent [19]

Csotonyi

[11] Patent Number: 5,409,250

[45] Date of Patent: Apr. 25, 1995

[54] POWER DRIVEN WHEEL CHAIR

[76] Inventor: Gyula Csotonyi, Box 346, Wabamun, Alberta, Canada, T0E 2K0

[21] Appl. No.: 239,131

[22] Filed: May 6, 1994

[51] Int. Cl.[6] ..... A61G 7/10

[52] U.S. Cl. ..... 280/304.1; 180/6.2; 180/8.2; 180/907; 280/763.1; 297/DIG. 10

[58] Field of Search ..... 180/6.2, 6.48, 6.66, 180/8.2, 8.3, 24.13, 907, 21; 280/250.1, 304.1, 290, 98, 763.1, 766.1, 767, 43.23, 43.22; 297/DIG. 10, DIG. 9; 5/81.1, 83.1

[56] References Cited

U.S. PATENT DOCUMENTS

| | | | |
|---|---|---|---|
| 3,049,364 | 8/1962 | Clay | 280/211 |
| 3,292,722 | 12/1966 | Bamberg | 180/9.24 |
| 3,442,345 | 5/1969 | Berger | 180/23 |
| 4,427,210 | 1/1984 | Wevers | 280/289 |
| 4,542,918 | 9/1985 | Singleton | 280/43.22 X |
| 4,730,684 | 3/1988 | Pedersen | 180/22 |
| 4,811,966 | 3/1989 | Singleton | 280/5.32 |
| 4,834,409 | 5/1989 | Kramer | 180/209 |
| 4,862,997 | 9/1989 | Eberle | 187/11 |
| 4,999,862 | 3/1991 | Hefry | 280/304.1 X |
| 5,018,933 | 5/1991 | Kramer | 414/542 |
| 5,020,818 | 6/1991 | Oxford | 280/250.1 |
| 5,064,209 | 11/1991 | Kurschat | 280/204 |
| 5,096,008 | 3/1992 | Mankowski | 180/6.5 |
| 5,163,340 | 11/1992 | Bender | 74/53 |
| 5,165,123 | 11/1992 | Colpron | 5/83.1 |
| 5,187,822 | 2/1993 | Merry | 5/86.1 |
| 5,201,084 | 4/1993 | Johnson | 5/81.1 |
| 5,201,377 | 4/1993 | Wilson | 180/6.5 |

FOREIGN PATENT DOCUMENTS

| | | | |
|---|---|---|---|
| 2003311 | 5/1990 | Canada | 180/907 |
| 3538432 | 6/1986 | Germany | B62B 5/02 |
| 52-44933 | 4/1977 | Japan | A61G 5/04 |
| 2139576 | 11/1984 | United Kingdom | B62B 5/02 |
| 9005515 | 5/1990 | WIPO | 180/907 |

*Primary Examiner*—Margaret A. Focarino
*Assistant Examiner*—Victor Johnson
*Attorney, Agent, or Firm*—Anthony R. Lambert

[57] ABSTRACT

A power driven wheel chair is described which includes a rear wheel support frame and at least two ground engaging rear wheels mounted in spaced relation to opposed sides of the rear wheel support frame. A front wheel support frame is pivotally secured to the rear wheel support frame for pivotal movement about a substantially horizontal axis. At least two ground engaging front wheels are mounted in spaced relation to opposed sides of the front wheel support frame. A drive motor provides motive force to at least one wheel of one of the pairs of at least two ground engaging wheels. A chair is mounted on one of the rear wheel support frame and the front wheel support frame. The wheel chair, as described, has added stability as relative pivoting of the rear wheel support frame and the front wheel support frame maintains the wheels in contact the ground at all times.

10 Claims, 14 Drawing Sheets

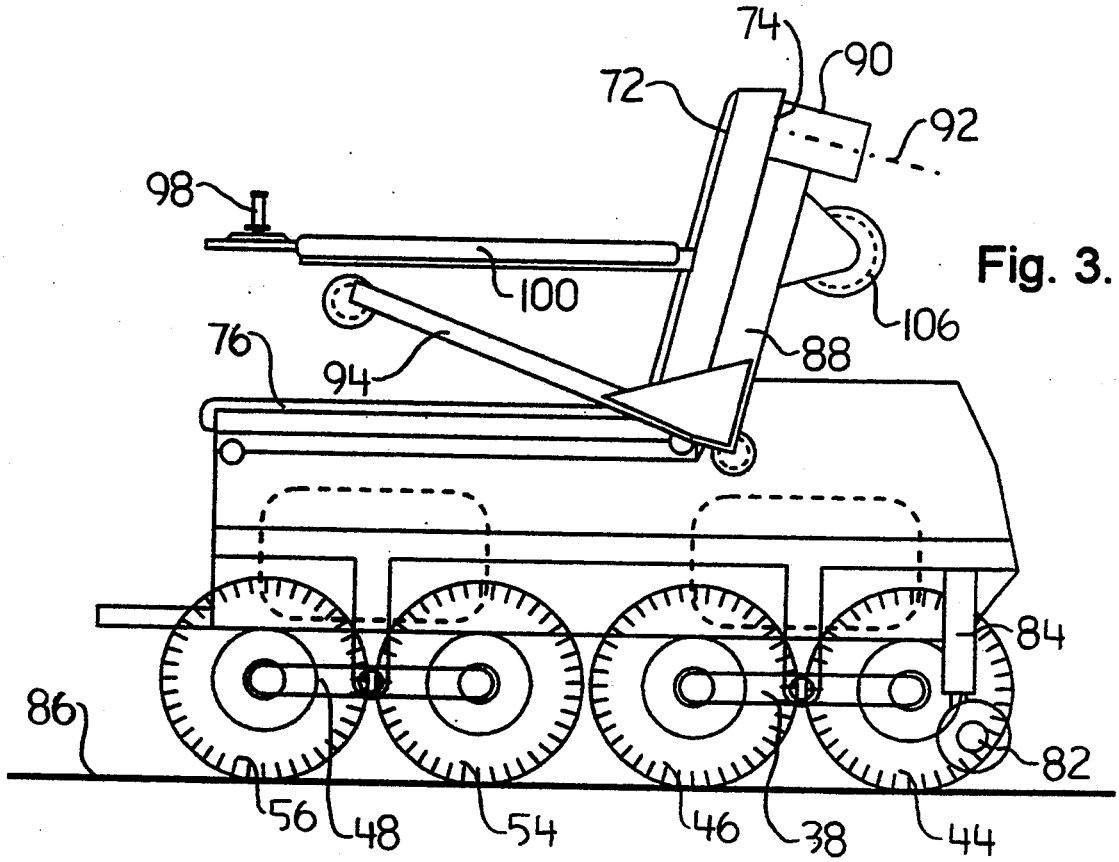
Fig. 3.
Fig. 4.
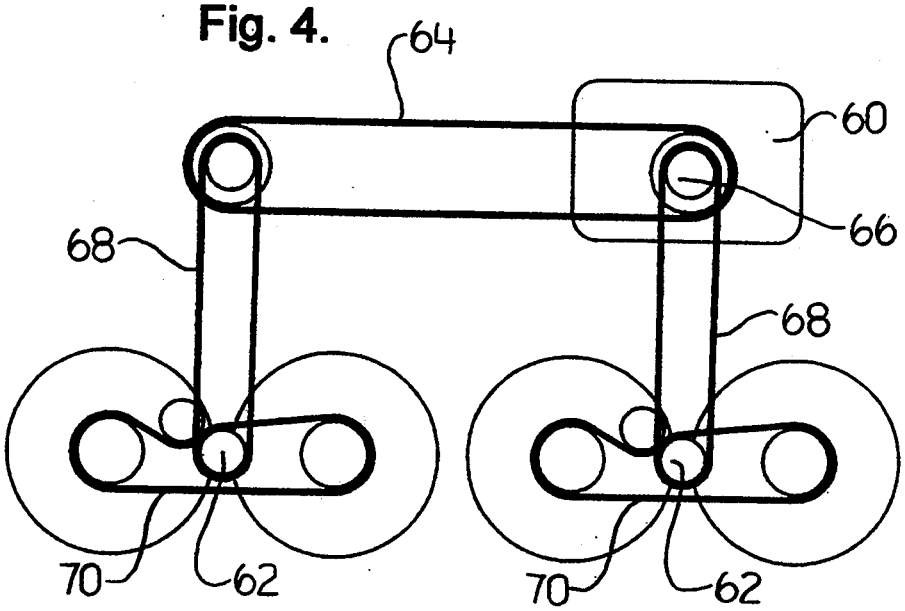

POWER DRIVEN WHEEL CHAIR

The present invention relates to a power driven wheel chair.

BACKGROUND OF THE INVENTION

Power driven wheel chairs enable persons who must use such conveyances greater freedom of movement. This is particularly apparent in relation to use out of doors. Power driven wheel chairs can go across uneven terrain that a hand propelled wheel chair could not possibly manage.

It is difficult for a power driven wheel chair to maintain all its wheels on the ground when stepping over obstacles. When one of the front wheels of a wheel chair climbs an obstacle, it tends to lift the rear wheel on the same side. When one of the front wheels of a wheel chair descends an obstacle, it tends to lift the rear wheel on the opposite side. These tendencies adversely effect the traction of the rear wheels, and the overall stability of the wheel chair.

SUMMARY OF THE INVENTION

What is required is a power driven wheel chair that is more stable when travelling over uneven terrain.

According to the present invention there is provided a power driven wheel chair which includes a rear wheel support frame and at least two ground engaging rear wheels mounted in spaced relation to opposed sides of the rear wheel support frame. A front wheel support frame is pivotally secured to the rear wheel support frame for pivotal movement about a substantially horizontal axis. At least two ground engaging front wheels are mounted in spaced relation to opposed sides of the front wheel support frame. A drive motor provides motive force to at least one wheel of one of the pairs of at least two ground engaging wheels. A chair is mounted on one of the rear wheel support frame and the front wheel support frame.

The wheel chair, as described above, has added stability as relative pivoting of the rear wheel support frame and the front wheel support frame maintains the wheels in contact the ground at all times. Although beneficial results may be obtained through the use of the power driven wheel chair, as defined above, there are further enhancements that can further improve the ability of the wheel chair to climb stairs. Even more beneficial results may, therefore, be obtained when each ground engaging wheel is mounted by means of a walking beam which includes a ground engaging companion wheel. It is preferred that each ground engaging wheel is driven by motive force supplied by the drive motor.

Although beneficial results may be obtained through the use of the power driven wheel chair, as defined above, a person riding in the wheel chair will not feel secure when positioned at an odd angle, and the wheel chair may tip if the center of gravity is not correctly positioned. Even more beneficial results may, therefore, be obtained when the chair is mounted on the support frame by means of a telescopic member. The telescopic member can expand and contract to maintain the chair in a substantially horizontal orientation regardless of the relative orientation of the support frame. The person riding in the wheel chair feels more secure when maintained in a horizontal position. This also performs the very important function of adjusting the center of gravity so the wheel chair is less prone to tipping. The telescopic mounting can also be used to raise the chair for other purposes, such as reaching high shelves.

Although beneficial results may be obtained through the use of the power driven wheel chair, as described above, if the wheel chair is to be suitable for indoor use it must be capable of making short radius turns. Even more beneficial results may, therefore, be obtained when a castor wheel is mounted by means of a telescopic member to one of the rear wheel support frame and the front wheel support frame. In an extended position the telescopic member lifts the ground engaging wheels off a ground surface thereby enabling the castor wheel supports the weight of the rear wheel support frame during short radius turns. This ability to make short radiused turns is further enhanced when means is provided for raising at least one of the ground engaging wheels mounted by means of the walking beam.

Although beneficial results may be obtained through the use of the power driven wheel chair, as described above, it is difficult for a person to get from the wheel chair into a bath tub without assistance. Any place where the person cannot use his arms to slide directly across can present a problem. Even more beneficial results may, therefore, be obtained when the chair has a back, and a crane is secured to the back of the chair, whereby a person is lifted on to and off of the chair. It is preferred that telescopically extendible stabilizing legs depend from the front wheel support frame. The stabilizing legs prevents the wheel chair from becoming overbalanced when the crane is under load. It is also preferred that the crane has a mounting assembly pivotable about an axis substantially perpendicular to the back portion of the chair. This enables the crane to pivot between an operative position with a boom of the crane positioned above a seat portion of the chair and a stored position with the boom of the crane positioned adjacent to the seat of the chair.

BRIEF DESCRIPTION OF THE DRAWINGS

These and other features of the invention will become more apparent from the following description in which reference is made to the appended drawings, wherein:

FIG. 3 is a side elevation view of the wheel chair illustrated in FIG. 1, with the crane in a stored position.

FIG. 4 is a side elevation view in longitudinal section of the wheel chair illustrated in FIG. 2.

DETAILED DESCRIPTION OF THE PREFERRED EMBODIMENT

Figure 1:
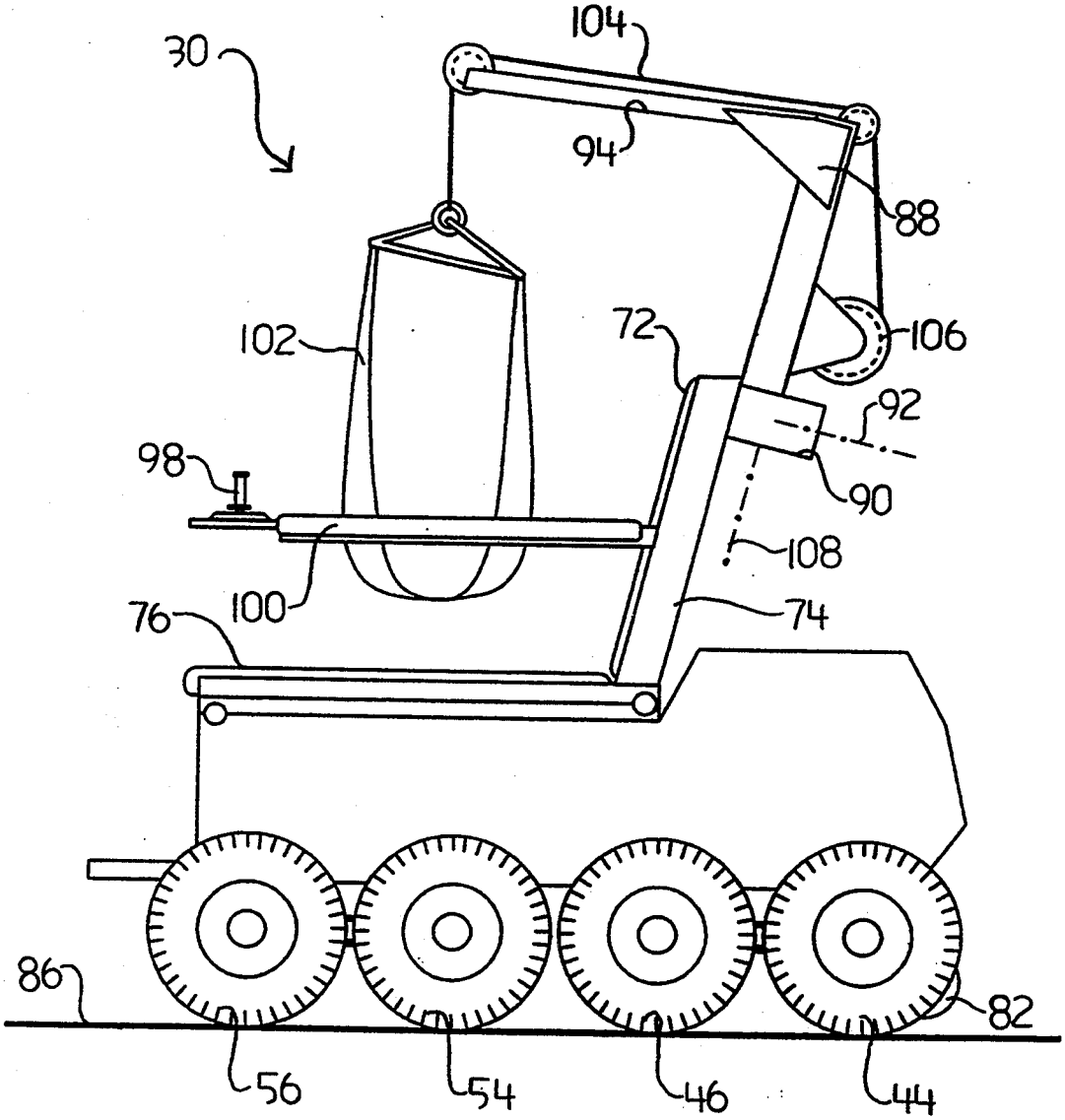
FIG. 1 is a side elevation view of a wheel chair constructed in accordance with the teachings of the present invention.

The preferred embodiment, a power driven wheel chair generally identified by reference numeral 30, will now be described with reference to FIGS. 1 through 21.

Figure 2:
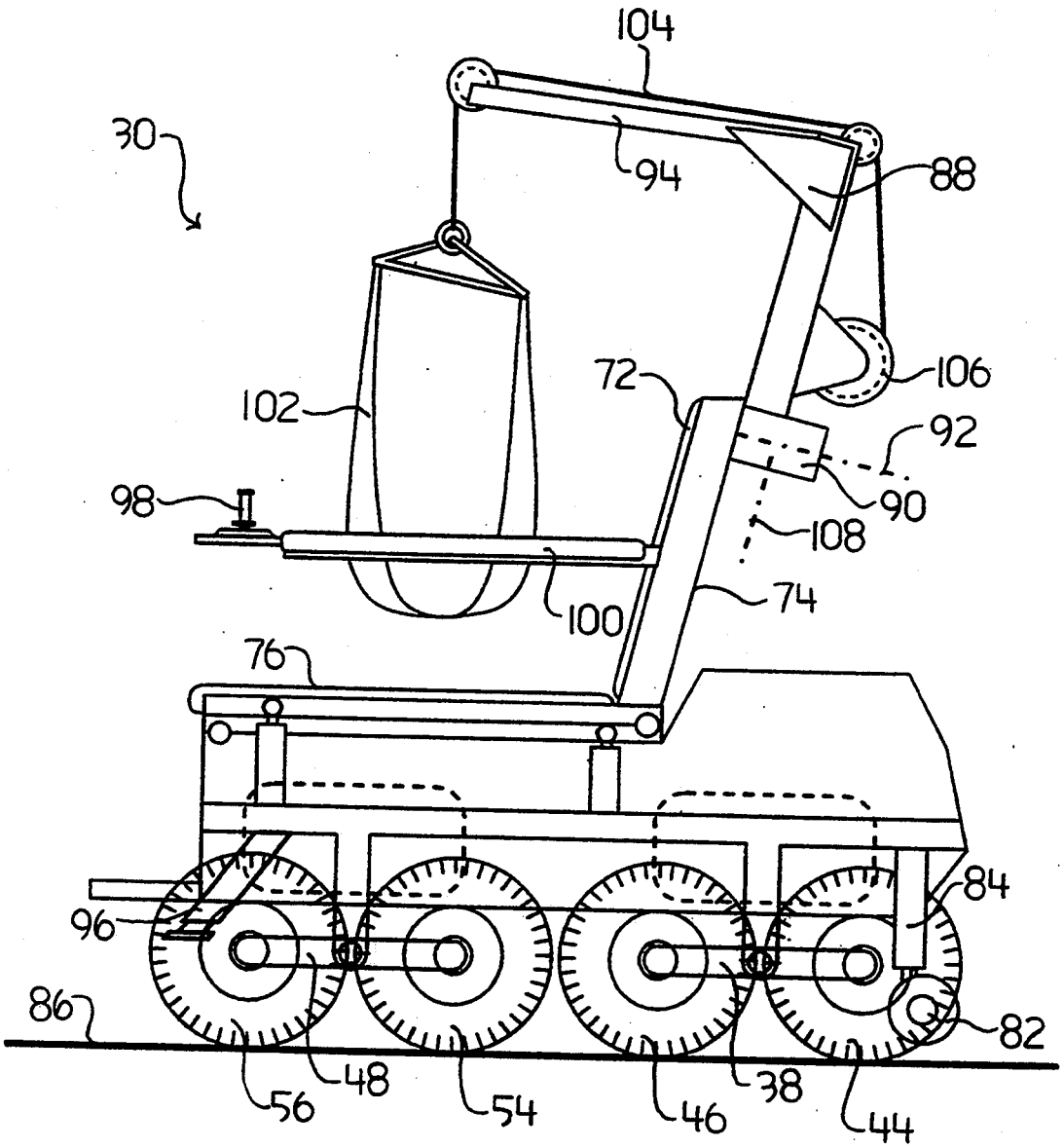
FIG. 2 is a side elevation view of the wheel chair illustrated in FIG. 1, with wheel mountings superimposed.
Figure 2A:
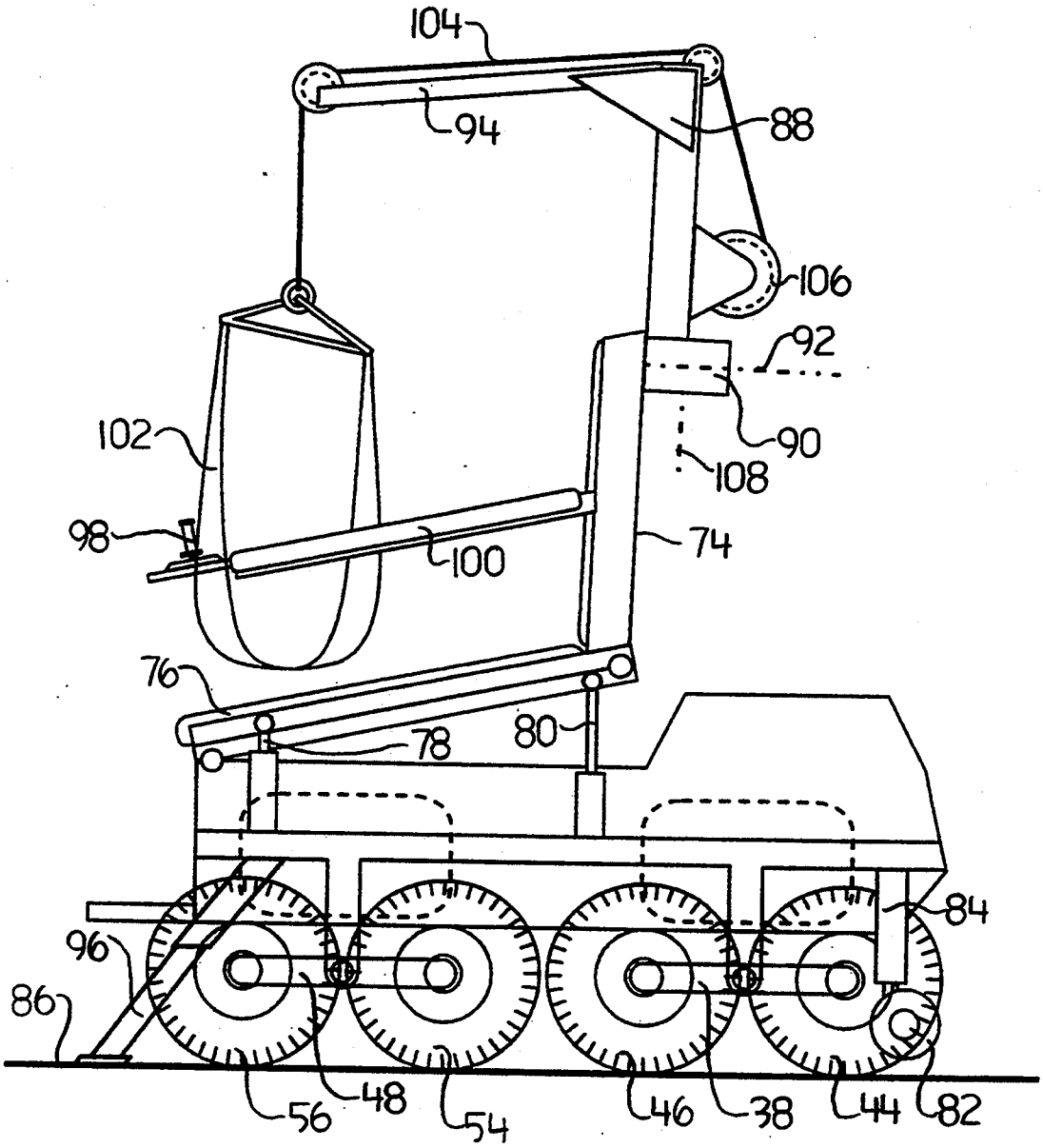
FIG. 2*a* is a side elevation view of the wheel chair illustrated in FIG. 1, with the crane in an operative position.
Figure 5:
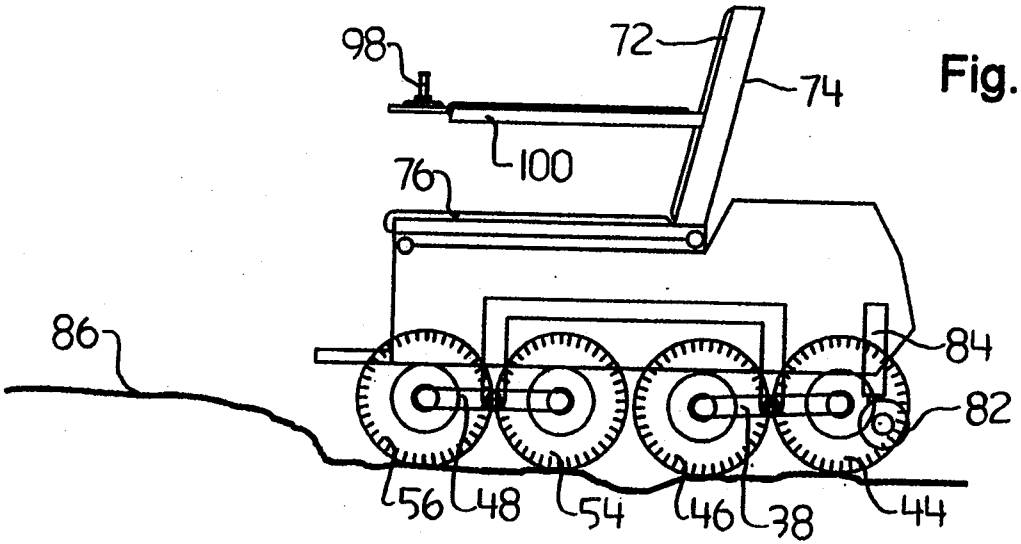
FIG. 5 is a side elevation view of the wheel chair illustrated in FIG. 2, and is the first of five drawings showing the manner in which the wheel chair maneuvers over uneven terrain.
Figure 6:
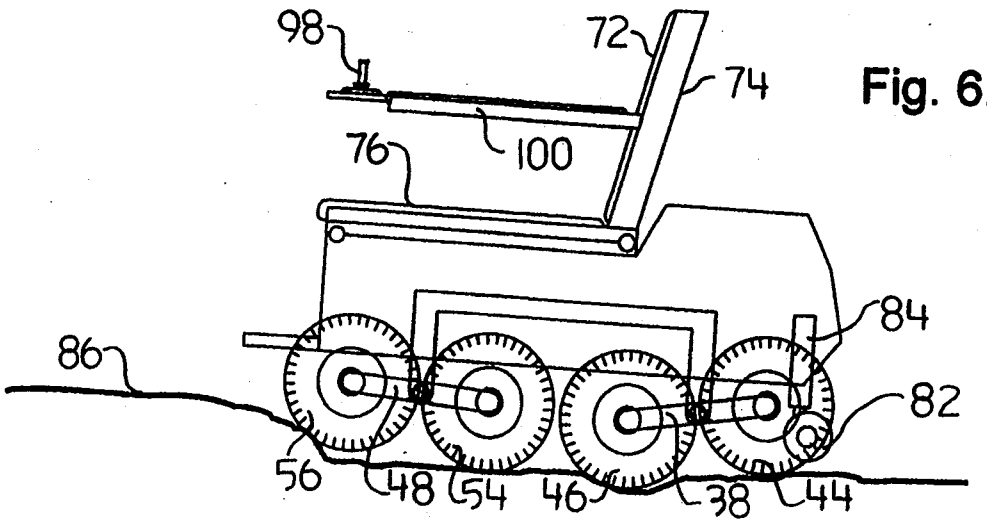
FIG. 6 is a side elevation view of the wheel chair illustrated in FIG. 2, and is the second of five drawings showing the manner in which the wheel chair maneuvers over uneven terrain.
Figure 7:
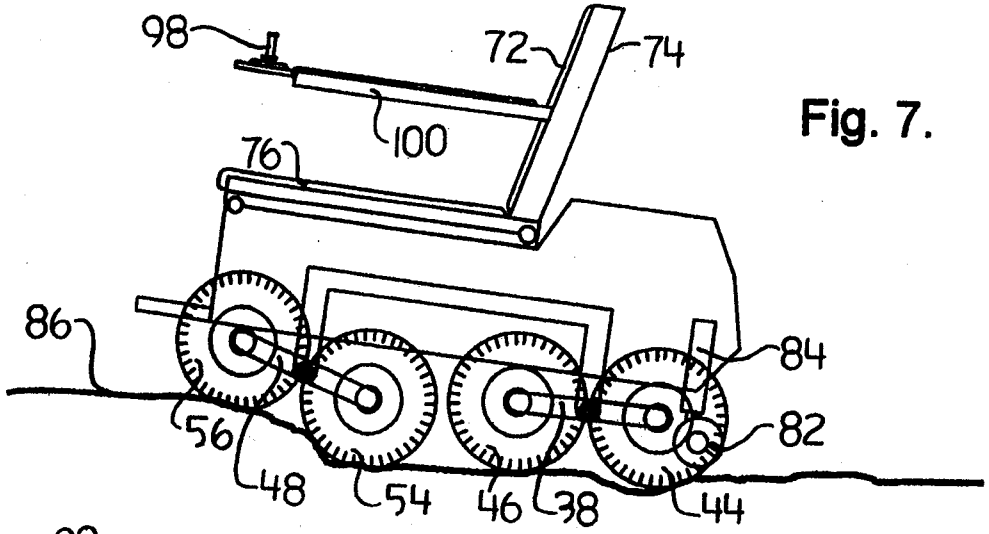
FIG. 7 is a side elevation view of the wheel chair illustrated in FIG. 2, and is the third of five drawings showing the manner in which the wheel chair maneuvers over uneven terrain.
Figure 8:
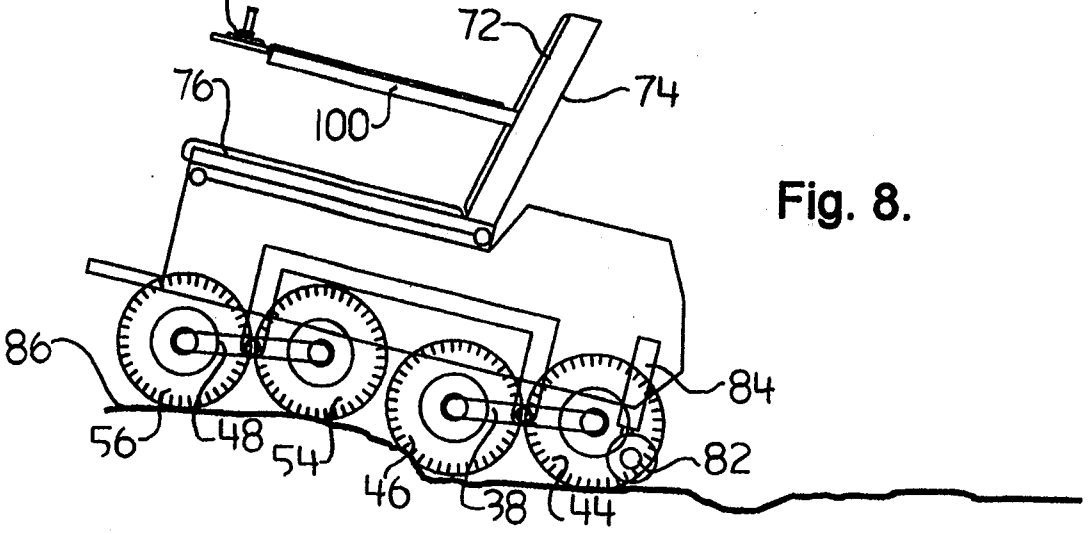
FIG. 8 is a side elevation view of the wheel chair illustrated in FIG. 2, and is the fourth of five drawings showing the manner in which the wheel chair maneuvers over uneven terrain.
Figure 9:
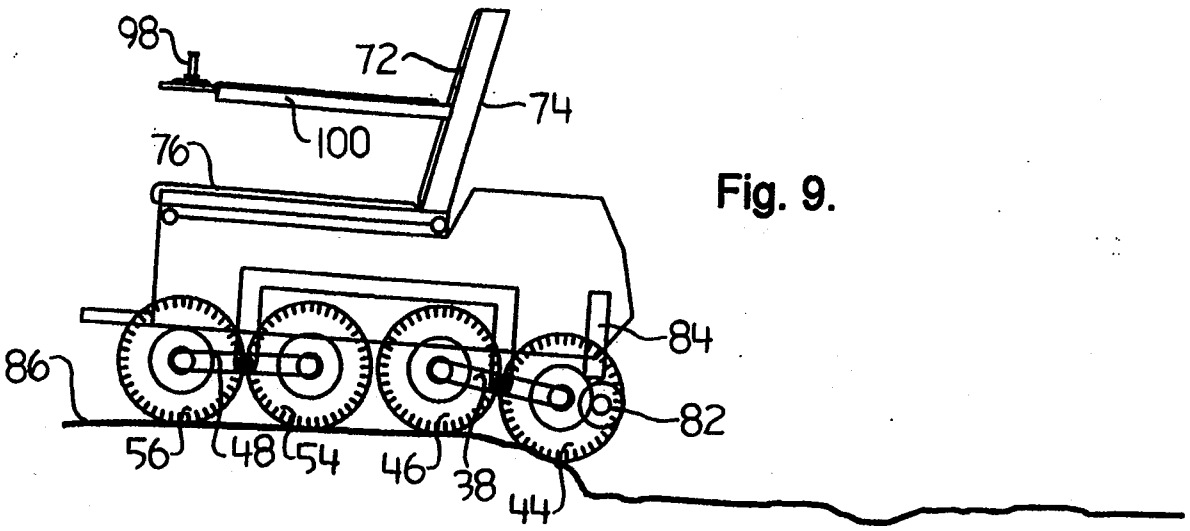
FIG. 9 is a side elevation view of the wheel chair illustrated in FIG. 2, and is the fifth of five drawings showing the manner in which the wheel chair maneuvers over uneven terrain.
Figure 12:
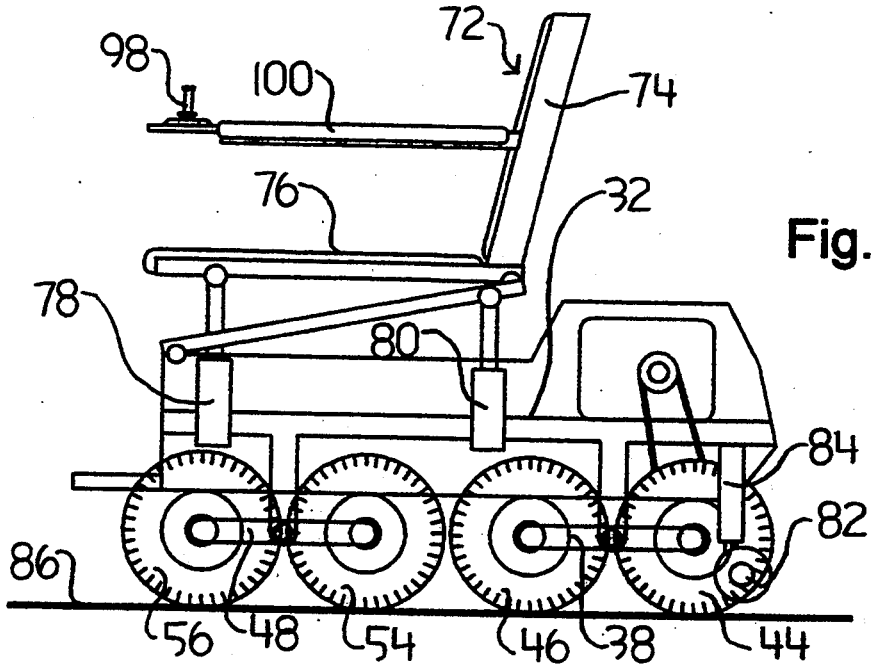
FIG. 12 is a side elevation view of the wheel chair illustrated in FIG. 2, and is the third of three drawings showing the manner in which the orientation of the chair is telescopically adjustable.
Figure 13:
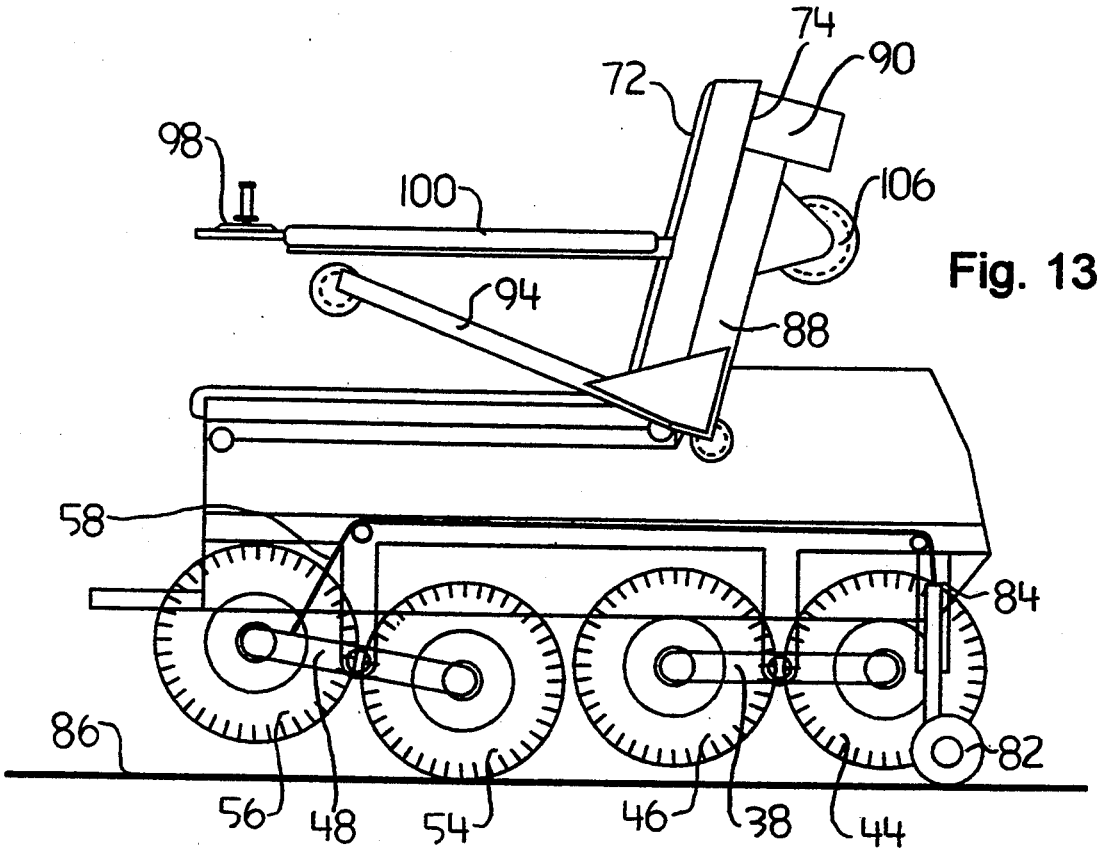
FIG. 13 is a side elevation view of the wheel chair illustrated in FIG. 2, shouting the manner in which short radius turns are executed.
Figure 14:
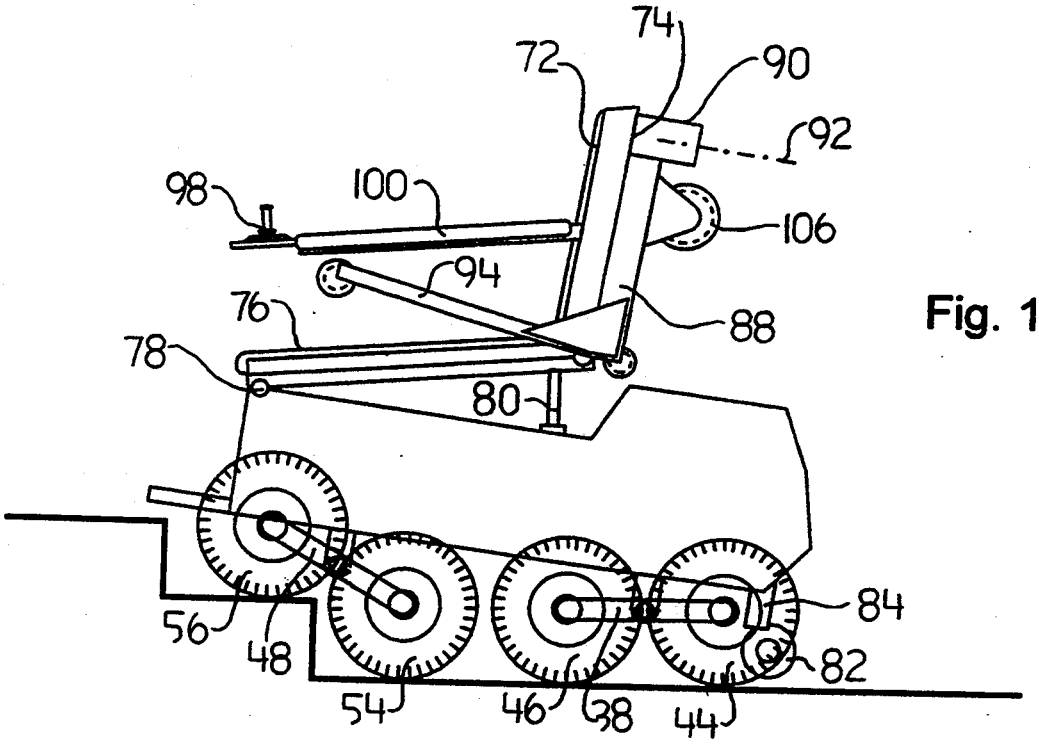
FIG. 14 is a side elevation view of the wheel chair illustrated in FIG. 2, and is the first of four drawings showing the manner in which stairs are negotiated.
Figure 15:
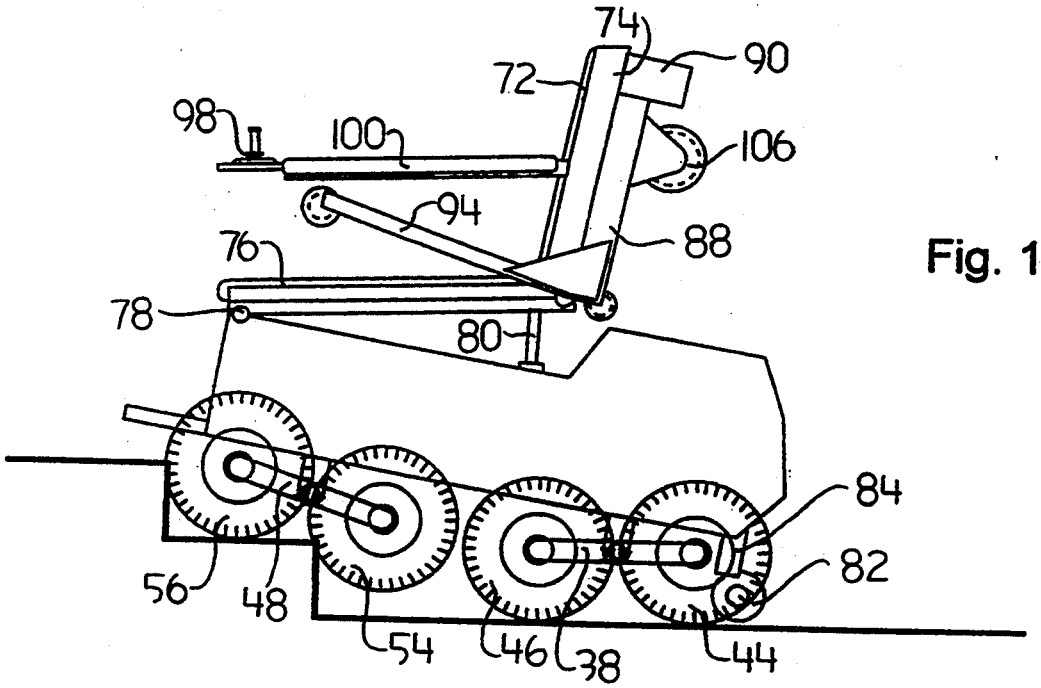
FIG. 15 is a side elevation view of the wheel chair illustrated in FIG. 2, and is the second of four drawings showing the manner in which stairs are negotiated.
Figure 16:
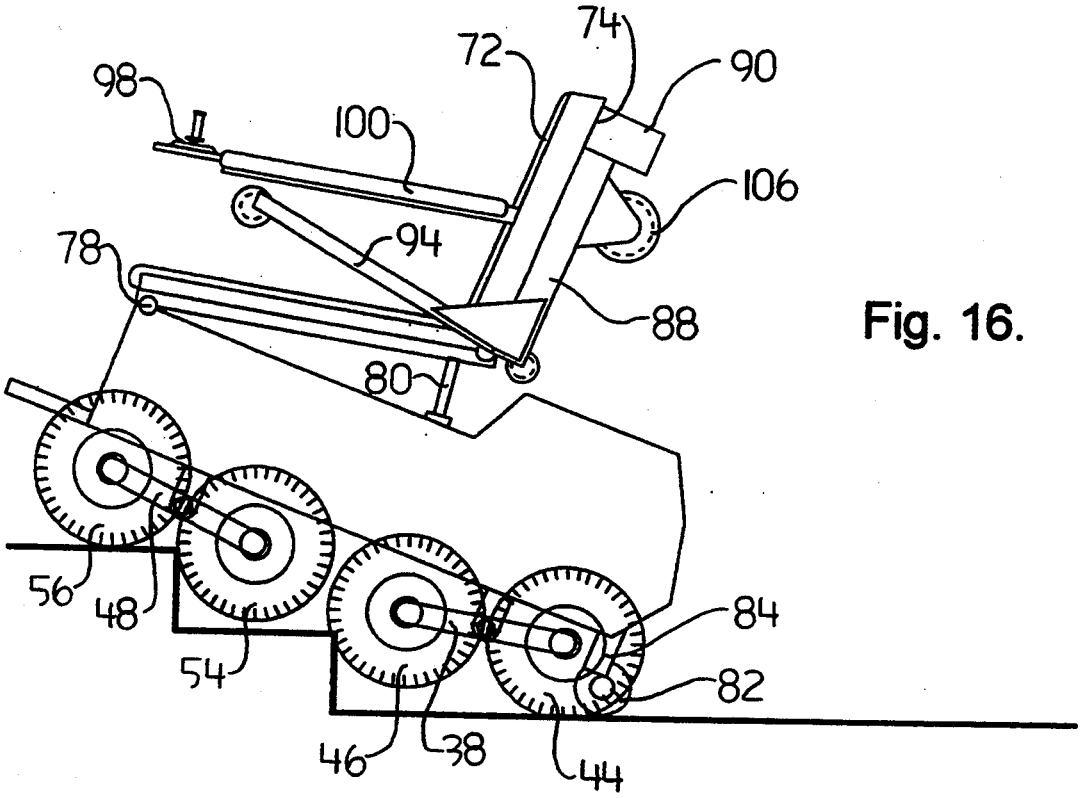
FIG. 16 is a side elevation view of the wheel chair illustrated in FIG. 2, and is the third of four drawings showing the manner in which stairs are negotiated.
Figure 17:
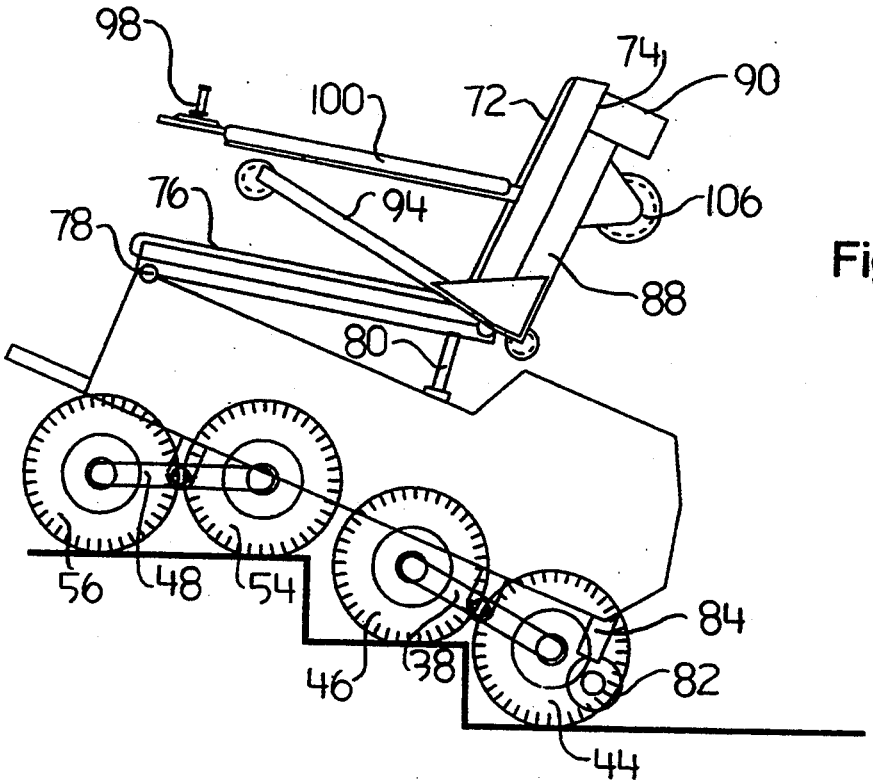
FIG. 17 is a side elevation view of the wheel chair illustrated in FIG. 2, and is the fourth of four drawings showing the manner in which stairs are negotiated.
Figure 18:
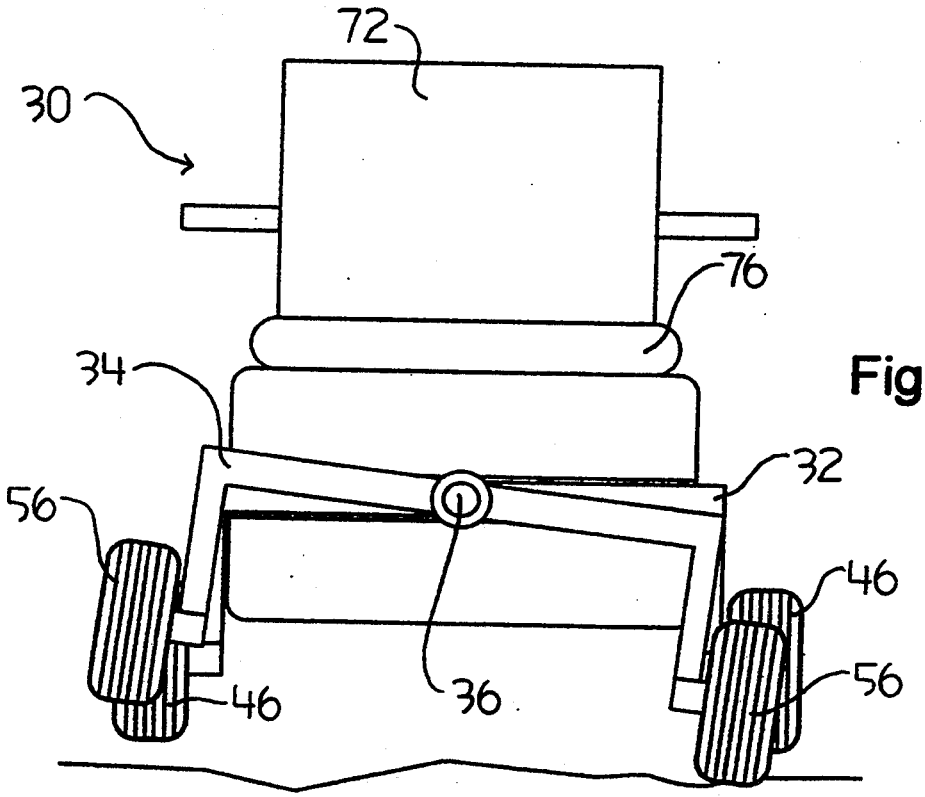
FIG. 18 is a front elevation view of the wheel chair illustrated in FIG. 2, and is the first of two drawings showing the manner in which obstacles are climbed.
Figure 19:
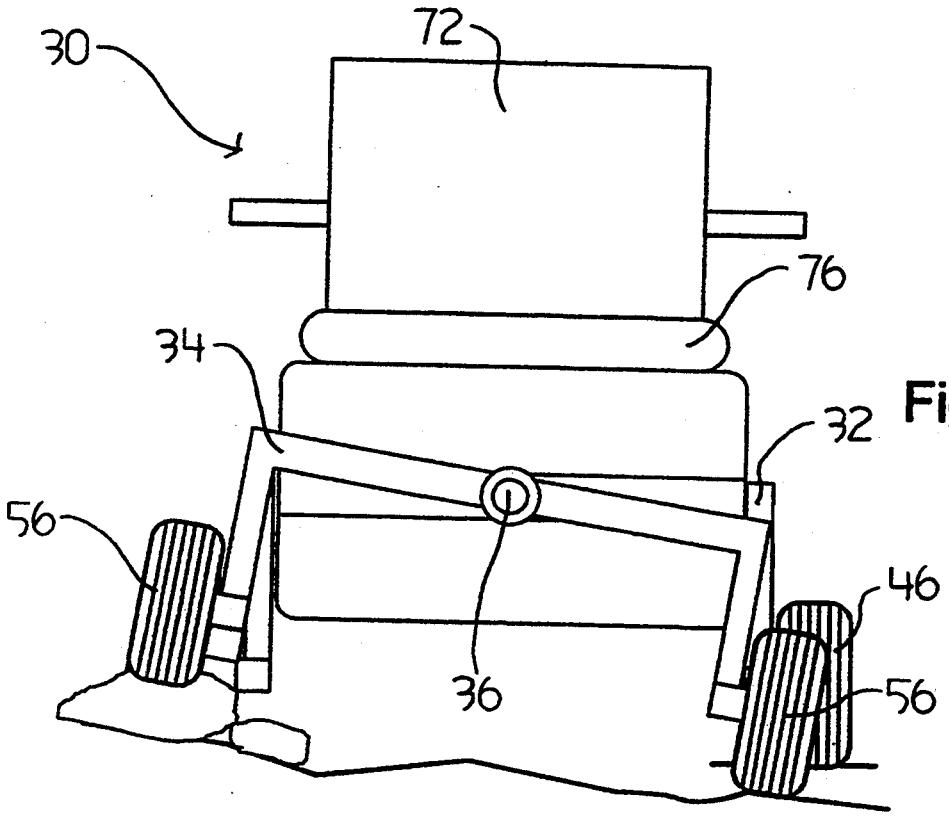
FIG. 19 is a front elevation view of the wheel chair illustrated in FIG. 2, and is the second of two drawings showing the manner in which obstacles are climbed.
Figure 20:
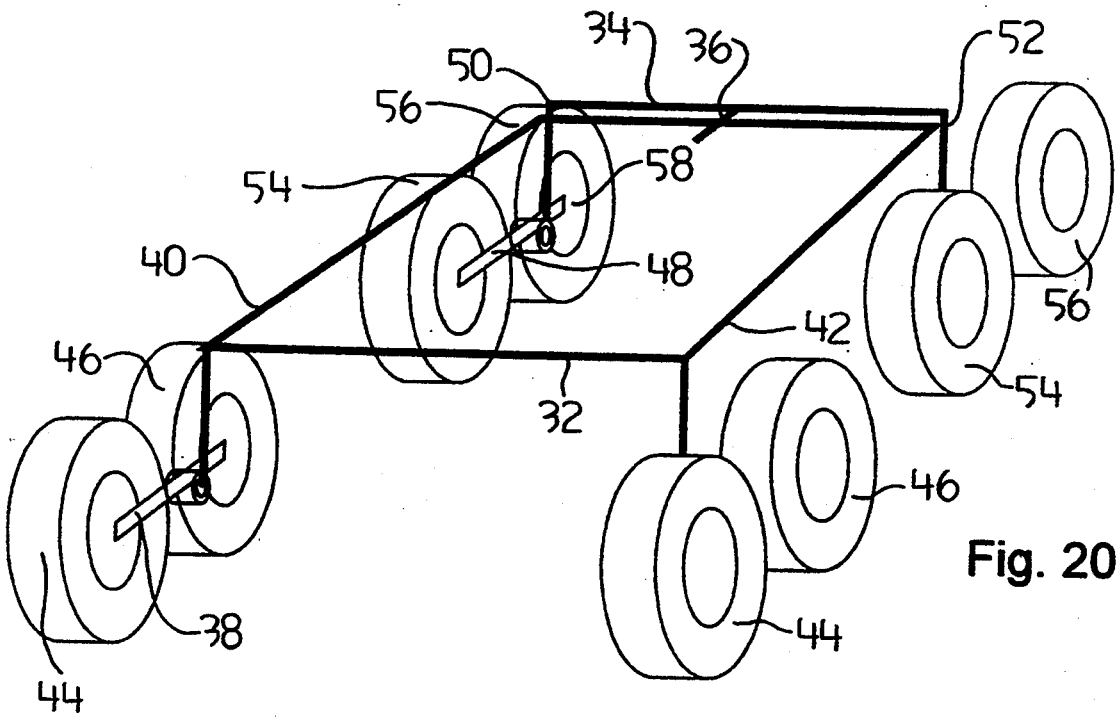
FIG. 20 is a rear perspective view of a frame from the wheel chair illustrated in FIG. 2.
Figure 21:
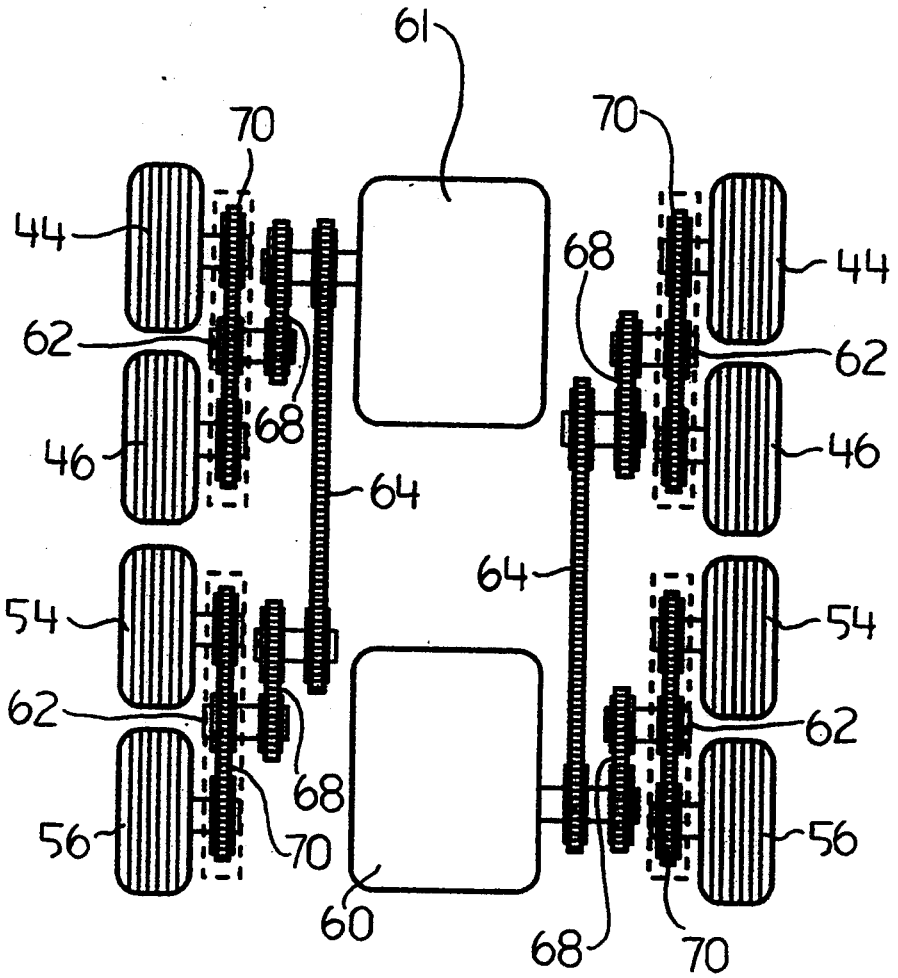
FIG. 21 is a top plan view in section of the wheel chair illustrated in FIG. 2.

Power driven wheel chair 30 is illustrated in FIG. 1. Referring to FIGS. 18 through 20, power driven wheel chair 10 includes a rear wheel support frame 32 and a front wheel support frame 34. Front wheel support frame 34 is pivotally secured to rear wheel support frame 32 for pivotal movement about a substantially horizontal axis, designated by reference numeral 36. Referring to FIG. 20, walking beams 38 are pivotally mounted in spaced relation to opposed sides 40 and 42 of rear wheel support frame 32. Each walking beam 38 includes a ground engaging wheel 44 and a ground engaging companion wheel 46. Similarly, walking beams 48 are pivotally mounted in spaced relation to opposed sides 50 and 52 of front wheel support frame 34. Each walking beam 48 includes a ground engaging wheel 54 and a ground engaging companion wheel 56. A cable is secured to walking beam 48 adjacent companion wheel 56. Cable 58 enables walking beam 48 to be selectively pivotable to raise ground engaging companion wheel 56 in the fashion illustrated in FIG. 13, as will hereinafter be further described. Rear wheel support frame 32 and front wheel support frame 34 are interchangeable. In the illustrated embodiment the shorter of the two frame sections has been designated as front wheel support frame 34. The designation of the ground engaging wheels as "companion" wheels relates to their connection to the drive system which will hereinafter be further explained. Referring to FIG. 21, two drive motors 60 and 61 provides the motive force to each ground engaging wheel 44 and 54 and each ground engaging companion wheel 46 and 56. The manner of connection is illustrated in FIGS. 4 and 21. Drive motor 60 provides the motive force for the operation of ground engaging wheels along sides 40 and 50 of support frames 32 and 34, respectively. Drive motor 61 provides the motive force for the operation of ground engaging wheels along sides 42 and 52 of support frames 32 and 34, respectively. A drive sprocket assembly 62 is positioned between each ground engaging wheel and its companion wheel. An output shaft 66 of each drive motor 60 and 61 is linked by drive chains 64 and 68 to each drive sprocket assembly 62. When either drive motor 60 or 61 is in operation, drive sprocket assemblies 62 are rotated via drive chains 64 and 68. Companion wheels 46 and 56 are rotatably linked by secondary drive chains 70 to ground engaging wheels 44 and 54, respectively. Drive sprocket assemblies 62 engage chains 70 to rotate ground ,engaging wheels 44 and 54 and companion wheels 46 and 56 together. Referring to FIG. 12, a chair 72 having a back portion 74 and a seat portion 76 is mounted on rear wheel support frame 32 by means of two telescopic members 78 and 80. Telescopic members 78 and 80 are hydraulic cylinders that .expand and contract to maintain chair 72 in a substantially horizontal orientation regardless of the relative orientation of rear wheel support frame 32. Referring to FIG. 13, a castor wheel 82 is mounted by means of a telescopic member 84 to rear wheel support frame 32. Telescopic member 84 is an hydraulic cylinder which, in an extended position, lifts ground engaging wheels 44 and 46 off a ground surface 86 thereby enabling castor wheel 82 supports the weight of the rear wheel support frame during short radius turns. It should be noted that telescopic member 84 is linked by cable 58 to walking beam 48. Referring to FIGS. 2, **2*a* and 3, a crane 88 is secured to back portion 74 of chair 72. Persons can be lifted on to and off of seat portion 76 of chair 72 with crane 88. As is apparent from a comparison of FIGS. 2 and 3, crane 88 has a mounting assembly 90 pivotable about an axis, designated by reference numeral 92, which is substantially perpendicular to back portion 74 of chair 72. This enables crane 88 to be pivoted between an operative position, illustrated in FIG. 2, with a boom 94 of crane 88 positioned above seat portion 76 of chair 72 and a stored position, illustrated in FIG. 3, with boom 94 of crane 88 positioned adjacent to seat portion 76 of chair 72. Referring to FIG. 2*a* , telescopically extendible stabilizing legs 96 depend from front wheel support frame 32. Referring to FIG. 1, controls 98 which control the operation of the various features of power driven wheel chair 10 are mounted onto an arm rest 100 extending from back portion 74 of chair 72. Associated with crane 88 are a sling support 102 which is suspended by a cable 104 from boom 94. The length of cable 104 is controlled by rotation of a motor driven feed spool 106. Crane 88 articulates about a substantially horizontal axis, identified by reference numeral 108**.

Figure 10:
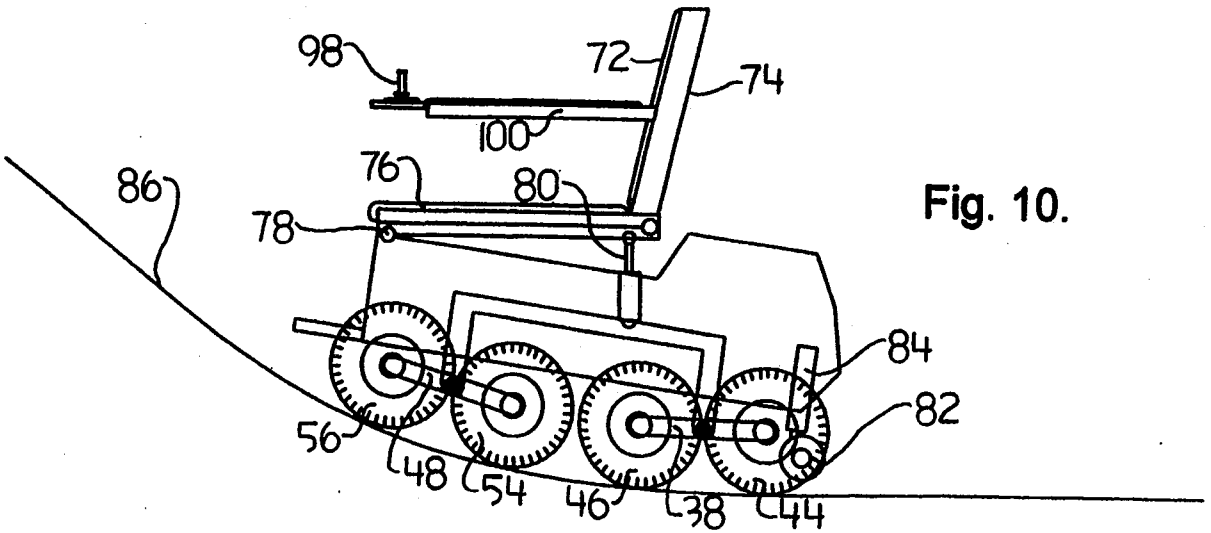
FIG. 10 is a side elevation view of the wheel chair illustrated in FIG. 2, and is the first of three drawings showing the manner in which the orientation of the chair is telescopically adjustable.
Figure 11:
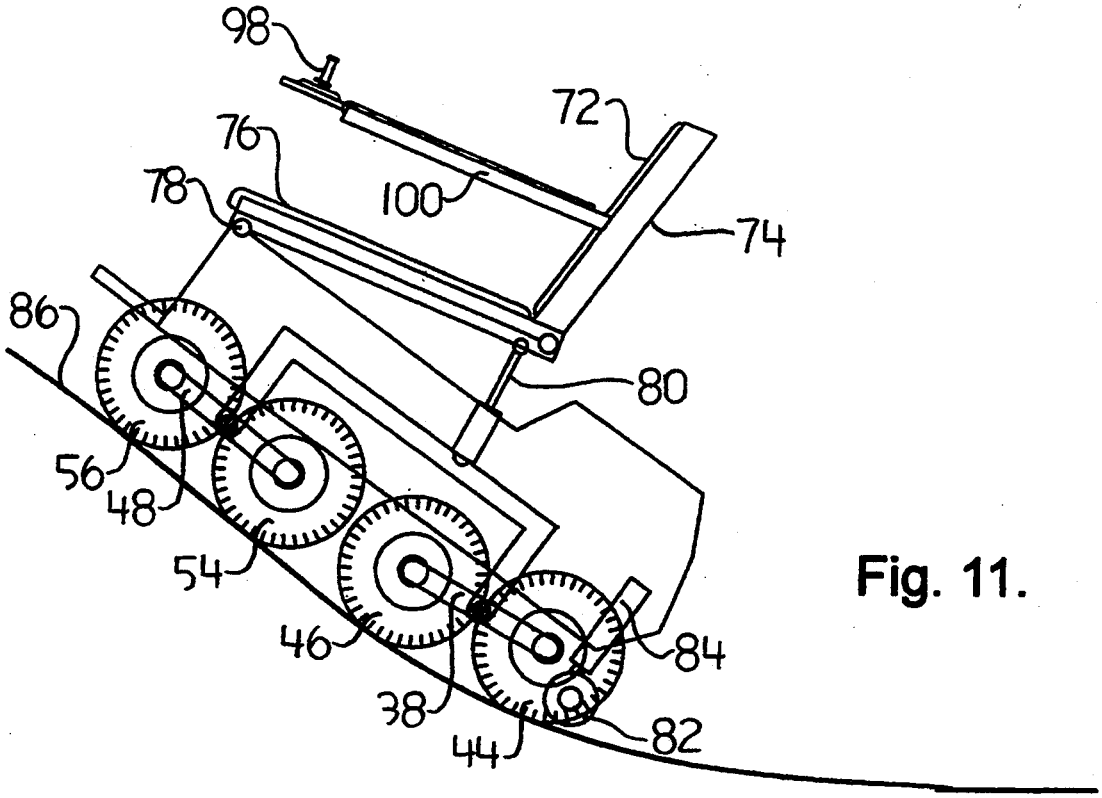
FIG. 11 is a side elevation view of the wheel chair illustrated in FIG. 2, and is the second of three drawings showing the manner in which the orientation of the chair is telescopically adjustable.

The use and operation of motor driven wheel chair 10 will now be described with reference to FIGS. 1 through 21. Crane 88 is used to lift persons on to and off of seat portion 76 of chair 72. Stabilizing legs 96 are telescopically extended in the manner illustrated in FIG. 2*a* to provide power driven wheel chair 10 with stability while lifting. Sling support 102 is placed around the torso of the person being lifted. The lifting force is applied by controlling the length of cable 104 from which sling support 102 is suspended. This is done by motor driven feed spool 106. Boom portion 94 of crane 88 is swung laterally as required about horizontal axis 108. When crane 88 is not required it is pivoted about pivot axis 92 into the stored position illustrated in FIG. 3. Referring to FIGS. 5 through 9, walking beams 38 and 48 assist in maintaining the ground engaging wheels in contact with ground surface 86 when travelling over rough terrain by pivoting to conform to the slope. Referring to FIGS. 10 and 11, telescopic members 78 and 80 expand and contract to maintain chair 72 in a substantially horizontal orientation regardless of the relative orientation of rear wheel support frame 32. Referring to FIG. 12, telescopic members 78 and 80 can both be expanded at the same time to lift the chair 72 to permit the person seated in chair 72 to reach high objects. Referring to FIG. 13, when a short radius turn is desired, telescopic member 84 is used to drop castor wheel 82. As telescopic member 84 extends cable 58 serves to pivot walking beam 48, lifting companion ground engaging wheel 56 off ground surface 86. Once telescopic member 84 is in a fully extended position, ground engaging wheels 44 and 46 are lifted off of ground surface 86 and castor wheel 82 supports the weight of the rear wheel support frame during short radius turns as ground engaging wheels 54 are rotated. This is accomplished by activating drive motor 60 to turn the ground engaging wheels on side 40 and 50 in one direction, while activating drive motor 61 to turn the ground engaging wheels on side 42 and 52 in the opposite direction. Referring to FIGS. 14 through 17, the manner in which power driven wheel chair 10 climbs stairs is illustrated. The manner in which walking beams 38 and 48 pivot is to be noted. This maintains wheels in contact with the stairs. Ground engaging wheels 44 and 54 and companion ground engaging wheels 46 and 56 assist each other with the climb. Referring to FIGS. 18 and 19, the manner in which front wheel support frame 34 pivots relative to rear wheel support frame 32 is illustrated. It is to be noted that the front wheels can climb or descend an obstacle without lifting the rear wheels off of ground surface 86.

It will be apparent to one skilled in the art the increased stability that power driven wheel chair 10 provides when performing various tasks. It will also be apparent to one skilled in the art that power driven wheel chair 10 performs a wide range of tasks that prior to its development could only be performed by having more than one wheel chair, as no one wheel chair could perform all the tasks illustrated. It will finally be apparent to one skilled in the art that modifications may be made to the illustrated embodiment without departing from the spirit and scope of the invention as defined by the Claims.

The embodiments of the invention in which an exclusive property or privilege is claimed are as follows:

1. A power driven wheel chair, comprising:

a. a rear wheel support frame;

b. at east two ground engaging rear wheels mounted in spaced relation to opposed sides of the rear wheel support frame;

c. a front wheel support frame secured to the rear wheel support frame;

d. at least two ground engaging front wheels mounted in spaced relation to opposed sides of the front wheel support frame;

e. a drive motor for providing motive force to at least one wheel of one of the ground engaging rear wheels and the ground engaging front wheels;

f. a chair having a back portion and a seat portion mounted on one of the rear wheel support frame and the front wheel support frame; and g. a crane secured to the back portion of the chair, whereby a person is lifted on to and off of the seat potion of the chair, the crane having a mounting assembly pivotable about an axis substantially perpendicular to the back portion of the chair, such that the crane is pivotable between an operative position with a boom of the crane positioned above the seat portion of the chair and a stored position with the boom of the crane positioned adjacent to the seat of the chair.

2. The power driven wheel chair as defined in claim 1, wherein the front wheel support frame is pivotally secured to the rear wheel support frame for pivotal movement about a substantially horizontal axis and each ground engaging wheel is mounted by means of a walking beam which includes a ground engaging companion wheel.

3. The power driven wheel chair as defined in claim 1, wherein each ground engaging wheel is driven by motive force supplied by the drive motor.

4. The power driven wheel chair as defined in claim 1, wherein the chair is mounted on the rear wheel support frame by means of a telescopic member, such that the telescopic member expands and contracts to maintain the chair in a substantially horizontal orientation regardless of the relative orientation of the rear wheel support frame.

5. The power driven chair as defined in claim 2, wherein a castor wheel is mounted by means of a telescopic member to the rear wheel support frame, such that in an extended position the telescopic member lifts the rear ground engaging wheels off a ground surface, a cable extending from the telescopic member to the walking beam of the front wheel support frame, such that as the telescopic member is telescopically extended the cable exerts a force upon the walking beam of the front wheel support frame to raise the ground engaging companion wheel off the ground surface.

6. The power driven wheel chair as defined in claim 1, wherein telescopically extendible stabilizing legs depend from the front wheel support frame.

7. A power driven wheel chair, comprising:

a. a rear wheel support frame;

b. walking beams pivotally mounted in spaced relation to opposed sides of the rear wheel support frame, each walking beam including a ground engaging wheel and a ground engaging companion wheel;

c. a front wheel support frame pivotally secured to the rear wheel support frame for pivotally movement about a substantially horizontal axis;

d. walking beams pivotally mounted in spaced relation to opposed sides of the front wheel support frame, each walking beam including a ground engaging wheel and a ground engaging companion wheel;

e. a drive motor for providing motive force to each ground engaging wheel and ground engaging companion wheel;

f. a chair having a back portion and a seat potion mounted on the rear wheel support frame by means of a telescopic member, such that the telescopic member expands and contracts to maintain the chair in a substantially horizontal orientation regardless of the relative orientation of the rear wheel support frame; and g. a crane secured to the back portion of the chair, whereby a person is lifted on to and off of the seat portion of the chair, the crane having a mounting assembly pivotable about an axis substantially perpendicular to the back portion of the chair, such that the crane is pivotable between an operative position with a boom of the crane positioned above the seat portion of the chair and a stored position with the boom of the crane positioned adjacent to the seat of the chair.

8. The power driven wheel chair as defined in claim 7, wherein a castor wheel is mounted by means of a telescopic member to the rear wheel support frame, such that in an extended position the telescopic member lifts the rear ground engaging wheels off a ground surface, a cable extending from the telescopic member to the walking beam of the front wheel support frame, such that as the telescopic member is telescopically extended the cable exerts a force upon the walking beam of the front wheel support frame to raise the ground engaging companion wheel off the ground surface.

9. The power driven wheel chair as defined in claim 7, wherein telescopically extendible stabilizing legs depend from the front wheel support frame.

10. A power driven wheel chair, comprising:

a. a rear wheel support frame;

b. walking beams pivotally mounted in spaced relation to opposed sides of the rear wheel support frame, each walking beam including a ground engaging wheel and a round engaging companion wheel;

c. a front wheel support frame pivotally secured to the rear wheel support frame for pivotal movement about a substantially horizontal axis;

d. walking beams pivotally mounted in spaced relation to opposed sides of the front wheel support frame, each walking beam including a ground engaging wheel and a ground engaging companion wheel;

e. a drive motor for providing motive force to each ground engaging wheel and ground engaging companion wheel;

f. a chair having a back potion and a seat potion mounted one the rear wheel support frame by means of a telescopic member, such that the telescopic member expands and contracts to maintain the chair in a substantially horizontal orientation regardless of the relative orientation of the rear wheel support frame;

g. a castor wheel mounted of a telescopic member to the rear wheel support frame, such that in an extended position the telescopic member lifts the rear ground engaging wheels off a ground surface, a cable extending from the telescopic member to the walking beam of the front wheel support frame, such that as the telescopic member is telescopically extended the cable exerts a force upon the walking beam of the front wheel support frame to raise the ground engaging companion wheel off the ground surface;

h. a crane secured to the back portion of the chair, whereby a person is lifted on to and off of the seat portion of the chair, the crane having a mounting assembly pivotable about an axis substantially perpendicular to the back portion of the chair, such that the crane is pivotable between an operative position with a boom of the crane positioned above the seat portion of the chair and a stored with the boom of the crane positioned adjacent to the seat of the chair; and i. telescopically extendible stabilizing legs depending from the front wheel support frame.

* * * * *